US007717193B2

(12) United States Patent
Egilsson et al.

(10) Patent No.: US 7,717,193 B2
(45) Date of Patent: May 18, 2010

(54) AC POWERED SERVICE RIG

(75) Inventors: Ted Egilsson, Red Deer (CA); Ken Andreasen, Surry (CA)

(73) Assignee: Nabors Canada, Calgary (CA)

( * ) Notice: Subject to any disclaimer, the term of this patent is extended or adjusted under 35 U.S.C. 154(b) by 143 days.

(21) Appl. No.: 11/877,597

(22) Filed: Oct. 23, 2007

(65) Prior Publication Data

US 2009/0101410 A1 Apr. 23, 2009

(51) Int. Cl.
*E21B 44/00* (2006.01)
*E21B 19/00* (2006.01)

(52) U.S. Cl. ..... 175/24; 166/77.1

(58) Field of Classification Search ..... 175/24; 173/27, 25, 184, 28; 166/77.1; 254/4 R, 254/278, 279, 280, 323
See application file for complete search history.

(56) References Cited

U.S. PATENT DOCUMENTS

| | | | | |
|---|---|---|---|---|
| 4,839,547 | A | 6/1989 | Lordo et al. | |
| 5,081,878 | A | 1/1992 | Stasiuk | |
| 5,248,005 | A * | 9/1993 | Mochizuki | 175/85 |
| 6,079,490 | A | 6/2000 | Newman | |
| 6,202,780 | B1 * | 3/2001 | Tanaka et al. | 180/179 |
| 6,276,449 | B1 | 8/2001 | Newman | |
| 6,575,056 | B1 | 6/2003 | Gnandt | |
| 7,004,456 | B2 * | 2/2006 | Newman | 254/323 |
| 7,138,925 | B2 | 11/2006 | Nield | |
| 7,225,878 | B2 | 6/2007 | Holcomb et al. | |
| 7,249,629 | B2 * | 7/2007 | Cunningham et al. | 166/77.1 |
| 2007/0119622 | A1 * | 5/2007 | Ayling | 175/5 |
| 2008/0203734 | A1 * | 8/2008 | Grimes et al. | 290/40 R |
| 2009/0071720 | A1 * | 3/2009 | Cowan | 175/57 |
| 2009/0084558 | A1 * | 4/2009 | Bloom | 166/385 |

FOREIGN PATENT DOCUMENTS

| | | |
|---|---|---|
| WO | WO2004/048751 | 6/2004 |
| WO | WO2004048249 | 6/2004 |
| WO | WO2005033907 | 4/2005 |
| WO | WO2005084246 | 9/2005 |

OTHER PUBLICATIONS

Weera Kaewjinda and Mogkol Konghirun; Vector control drive of permanent magnet synchronous motor using resolver sensor; ECTI Transactions on Electrical Eng., Electronics, and Communications vol. 5, No. 1, Feb. 2007.
Larry Plachno; ZF's AS Tronic Transmission Moves into High Gear; National Bus trader; Oct. 2005.
GearTools ZF AS Tronic transmission in volume production; Thursday, Oct. 13, 2005; http://www.geartools.co.uk/mambo/index2.php?option=com_content&task=....

* cited by examiner

*Primary Examiner*—David J Bagnell
*Assistant Examiner*—Michael Wills, III
(74) *Attorney, Agent, or Firm*—Sean W Goodwin

(57) ABSTRACT

An electrically-powered service rig utilizes an engine-driven generator to power a propulsion system, a drawworks system and a sandline system, all mounted on a single mobile platform. The rig utilizes lightweight permanent magnet motors to enable integration of the systems onto a single mobile platform which meets transport regulations. The rig's power plant is capable of powering other onsite equipment such as mud pump motors through use of umbilicals connected to the engine-driven generator.

20 Claims, 18 Drawing Sheets

70
82
76
58,74
16
20
114
26
58,112
18
126
34
58,124
Remote Controls
58,102
400
54
72
110
112
54
PM VFD
MP VFD
80
52
GEN
50
CAT C13
AC
DC
Cab Controls
Press / Temp / Shift / Mag Pickup / Breaker Control
Temps / DVR / Volts / Freq / Status
J1939
Aux
Temp / Press / Encoders / Shift / Brake
RS 485
Breaker Control
DeviceNet
Temp / Press / Encoders / Shift / Brake
PLC
49
56

18
22
32
14
38
48
30
126
128
34
122
120
124
M
Max Speed
F,37
35,F
36,36s
46
28
F,35

AC POWERED SERVICE RIG

FIELD OF THE INVENTION

Embodiments of the invention relate to service rigs for servicing wellbores and, more particularly, to an integrated power system for powering at least the propulsion, drawworks and sandline on a service rig.

BACKGROUND OF THE INVENTION

Oil wells typically require some servicing during the lifetime of the wellbore whether it be to increase production, such as by acidizing or fracturing the formation and the like, perform testing on the formation or the wellbore integrity, replace components such as sucker rods or production tubing or casing or to perform a variety of other operations as necessary.

Service rigs are typically designed to at least have the capacity to trip out or run in the production tubing and to run in and trip out a variety of downhole tools. Conventionally, the service rig generally comprises at least a drawworks for raising and lowering tubulars and the like and typically a sandline for raising and lowering downhole tools such as during swabbing operations. Each of the drawworks and sandline are typically powered by diesel motors to which they are mechanically connected. The conventional powering systems typically do not provide as fine a motor control of the drawworks and the sandline as is desired for servicing operations. AC motors are used in the drilling industry where weight is less of a limitation on design.

Production tubing typically cannot handle as much torque as a drill stem and therefore more control is required for tripping out and running in of production tubing as compared to drill pipe. Conventional positioning of components into or out of the wellbore for servicing therefore has required careful and continuous monitoring and management of at least the drawworks and sandline systems by the onsite driller to ensure safe operations.

Conventionally power has been provided for braking systems on the drawworks and the sandline drums through diesel motors and mechanical connections associated therewith. Similarly in conventional rigs, hydraulic motor systems are also provided to operate tongs and slips required to break or make sections of tubing from the tubing string as it removed from or inserted into the wellbore.

In many cases, where the formation is to be treated by chemicals, pumping units are brought onsite to provide specialized treatment fluids which are pumped into the wellbore. The pumping unit is typically provided with a separate power source onsite.

Service rigs are generally portable rigs which comprise a transportable platform mounted on an undercarriage and which are powered by a propulsion system for moving the rig from wellsite to wellsite. Conventionally propulsion systems for service rigs are separately powered and typically comprise at least a large diesel engine carried on the platform and mechanically connected to the transmission through a gear box. A plurality of axle/wheel configurations are typically available for the undercarriage so as to conform to Department of Transport regulations. Service rigs must be capable of carrying a significant amount of weight given the diverse equipment mounted thereon and must also be able to meet regulations governed by road bans to permit servicing of wellbores throughout the year and under a variety of environmental condition. This becomes a challenge for rig manufacturers who must balance the competing requirement of the industry for greater functionality of the rig while trying to reduce the weight to meet the road ban conditions.

Additionally, there are electrical requirements onsite to support servicing operations such as hotel loads, onsite lighting and other such requirements which are conventionally provided by one or more small generators separately provided.

There is a need to provide improved power systems for service rigs that are efficient, supply the needs of the operations at the wellsite and which do not add significantly to the problems associated with the weight of the rig so as to maintain maximum transportability.

SUMMARY OF THE INVENTION

A substantially electrically-powered service rig housed on a single mobile platform utilizes electrical power generated by an on-board engine-driven AC generator to power an electrical propulsion system, a drawworks system and a sandline system. Further, through use of electrical umbilical power requirements for separately transportable mud pumps systems and hotel loads may be met. In some embodiments, the prior art use of three generators can be reduced to one.

The system utilizes permanent magnet motors to drive a semi or fully automatic manual transmission and the driven shafts of the drawworks and sandline drums under the control of programmable logic controllers through variable frequency drives. Use of the permanent magnet motors, the electrical propulsion system and electric motor braking systems for the propulsion system and drawworks and sandline drums results in a significant weight reduction over the use of conventional induction motors enabling integration of the propulsion system, drawworks system and sandline system on a single mobile unit and which meets transport regulations.

In a broad aspect of the invention, an electrically-powered well service rig comprises: a mobile platform for transporting the service rig; an engine-driven generator carried by the platform for generating AC power; a propulsion system carried by the platform for transporting the mobile platform service rig having a collapsible mast thereon, the propulsion system having a permanent magnet propulsion motor for driving the platform, a propulsion variable frequency drive (VFD) connected between the generator and the propulsion motor; a drawworks system carried by the platform and having blocks adapted for raising and lowering a plurality of tubulars into and out of a wellbore, the drawworks system having at least a drawworks drum having drawworks cable wound thereon and rotatably driven by a permanent magnet drawworks motor; a drawworks VFD connected between the generator and the drawworks motor; a sandline system carried by the platform and adapted for raising and lowering a sandline tool into and out of a wellbore, the sandline system having at least a sandline drum having sandline cable wound thereon and rotatably driven by a permanent magnet sandline motor; a sandline VFD connected between the generator and the sandline motor; and one or more programmable logic controllers (PLC) carried by the platform for outputting speed setpoints to the propulsion VFD, the drawworks VFD; and the sandline VFD.

BRIEF DESCRIPTION OF THE DRAWINGS

FIG. 14A illustrates the sandline in a bottomhole position, a sandline cable payed out from the sandline drum for positioning apparatus connected thereto adjacent a bottom of a wellbore and illustrating a speed profile related to an entire depth from the rig to the bottom of the wellbore;

FIG. 14B illustrates the sandline of FIG. 14A, the sandline cable payed out from the sandline drum for positioning apparatus connected thereto intermediate the wellbore; and FIG. 14C illustrates the sandline system of FIG. 14A, the sandline cable payed out from the sandline drum for positioning apparatus connected thereto adjacent a wellhead at a top of the wellbore;

DETAILED DESCRIPTION OF THE PREFERRED EMBODIMENT

Figure 1A:
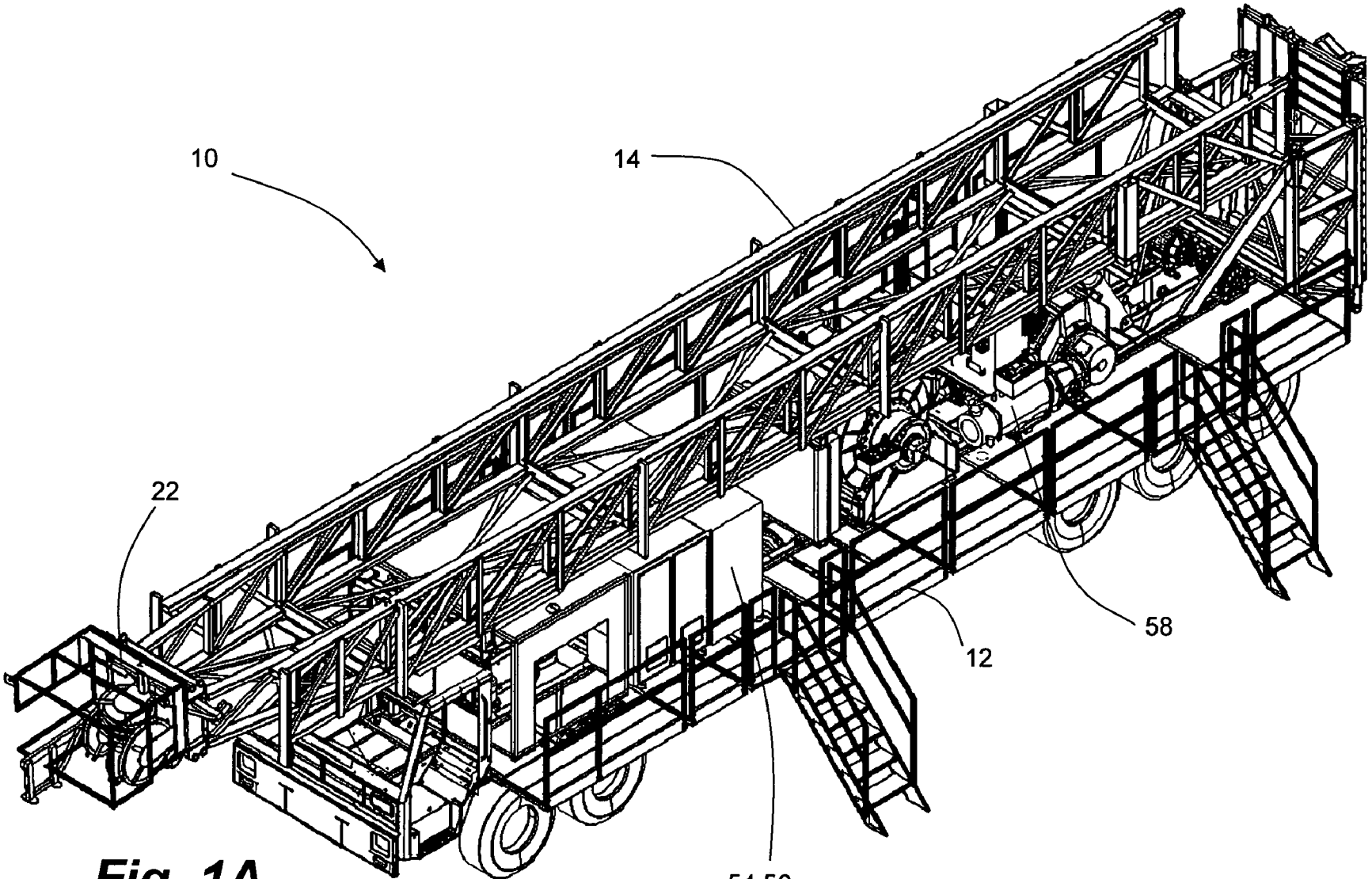
FIG. 1A is a perspective view of a substantially fully electrically-powered service rig according to an embodiment of the invention, a collapsible mast being shown in a folded transport position.
Figure 1B:
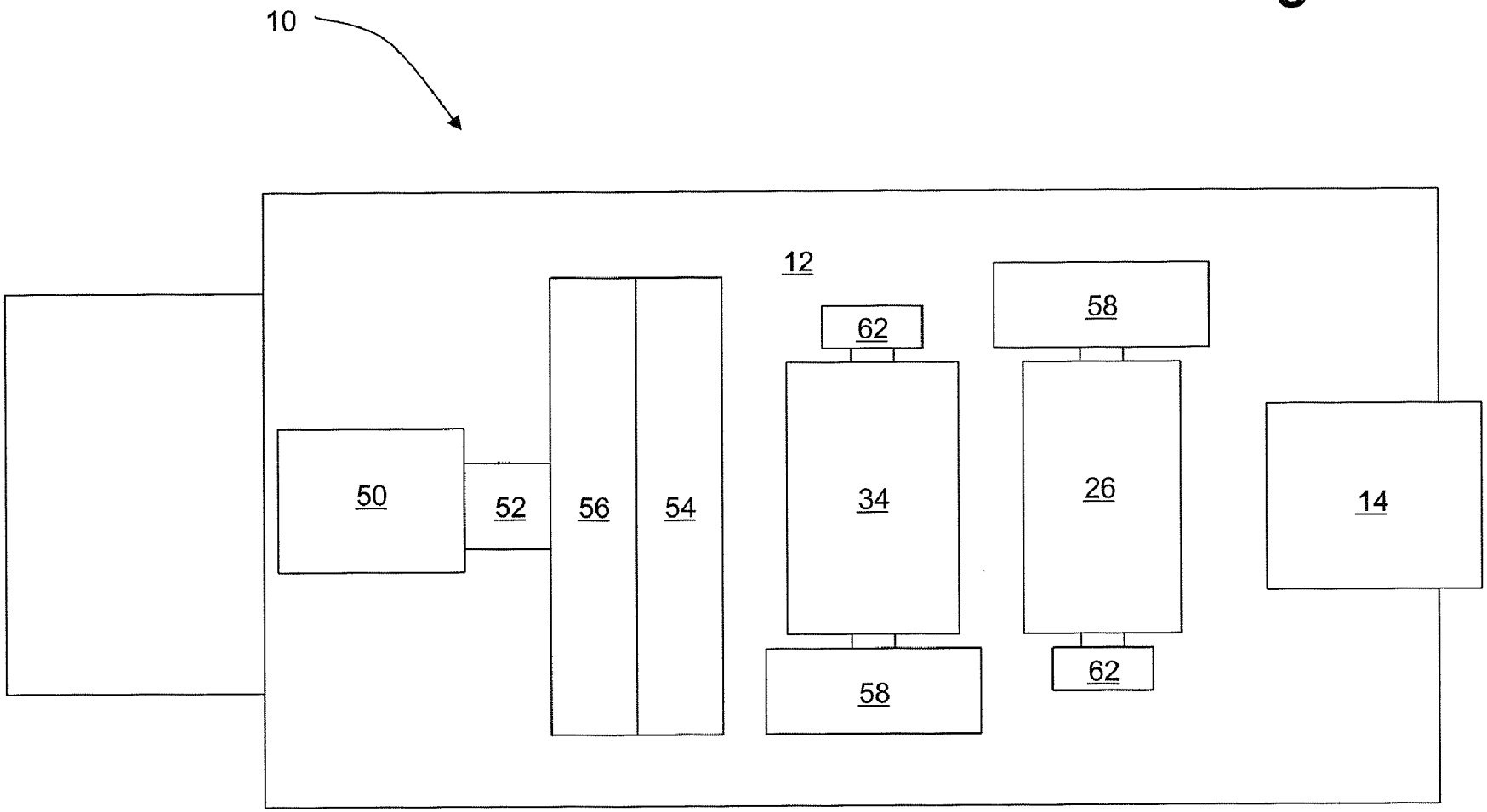
FIG. 1B is a plan view schematic illustrating components of the rig according to FIG. 1A.
Figure 2:
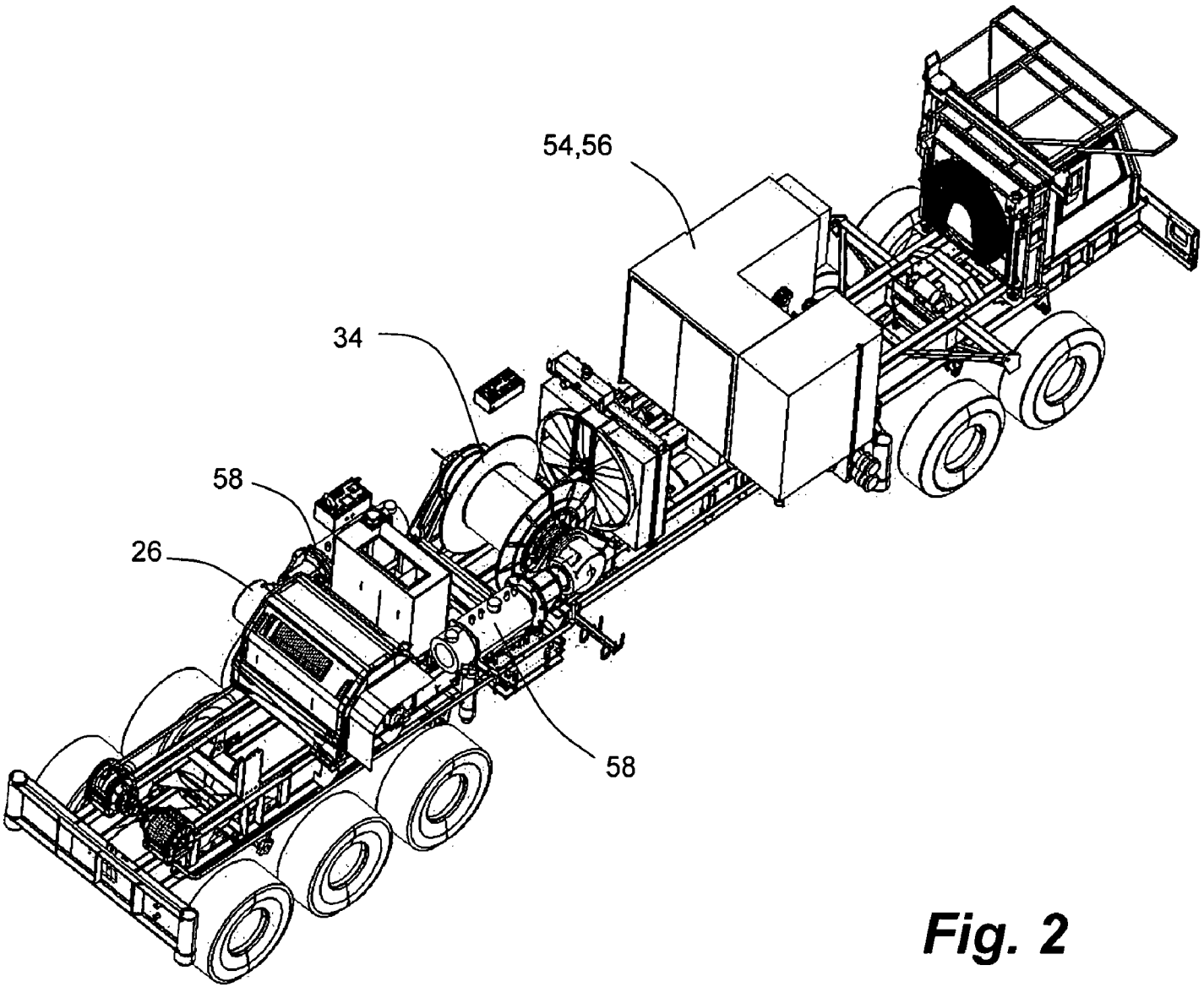
FIG. 2 is a right perspective rear view of the service rig of FIG. 1, the mast and railings removed for clarity.

Having reference to FIGS. 1A-5, 8, 10 and 14A-14C, a substantially electrically-powered well service rig 10 comprises an integrated AC power system for powering both propulsion for a mobile service rig platform 12 and the apparatus used for performing service operations. The well service rig 10 comprises a mast or collapsible mast 14, and hoisting capability, such as a drawworks system 16, sandline system 18 or both. The drawworks system 16 typically comprises multi-line blocks 20 supported from a crown 22 of the mast 14 which are raised and lowered in the mast 14 using drawworks cable 24 wound about a drawworks hoist drum 26. Elevators supported from the blocks 20 handle apparatus such as lengths of tubing run into and tripped out of a well 28. The well service rig 10 can further comprise the sandline system 18. The sandline system 18 is raised and lowered through the mast 14 using a sandline cable 30 extending over a sheave 32 in the crown 22 and wound about a sandline drum 34. Downhole apparatus or sandline tools 36 such as a swabbing tool 36*s* (FIGS. 14A-14C) are raised and lowered through the wellbore 28 connected to the sandline system 18.

In an embodiment of the invention as shown in FIGS. 1-5, and in more detail, the service rig's mobile platform 12 comprises an undercarriage 60 for transport as a self-propelled portable unit, typically in a truck-type format. The undercarriage 60 may comprise a variety of wheel/axle formats as required to meet Department of Transport guidelines. Although not detailed in FIG. 3, engine 50 and generator 54 are generally located over the platform's front wheels.

Figure 10:
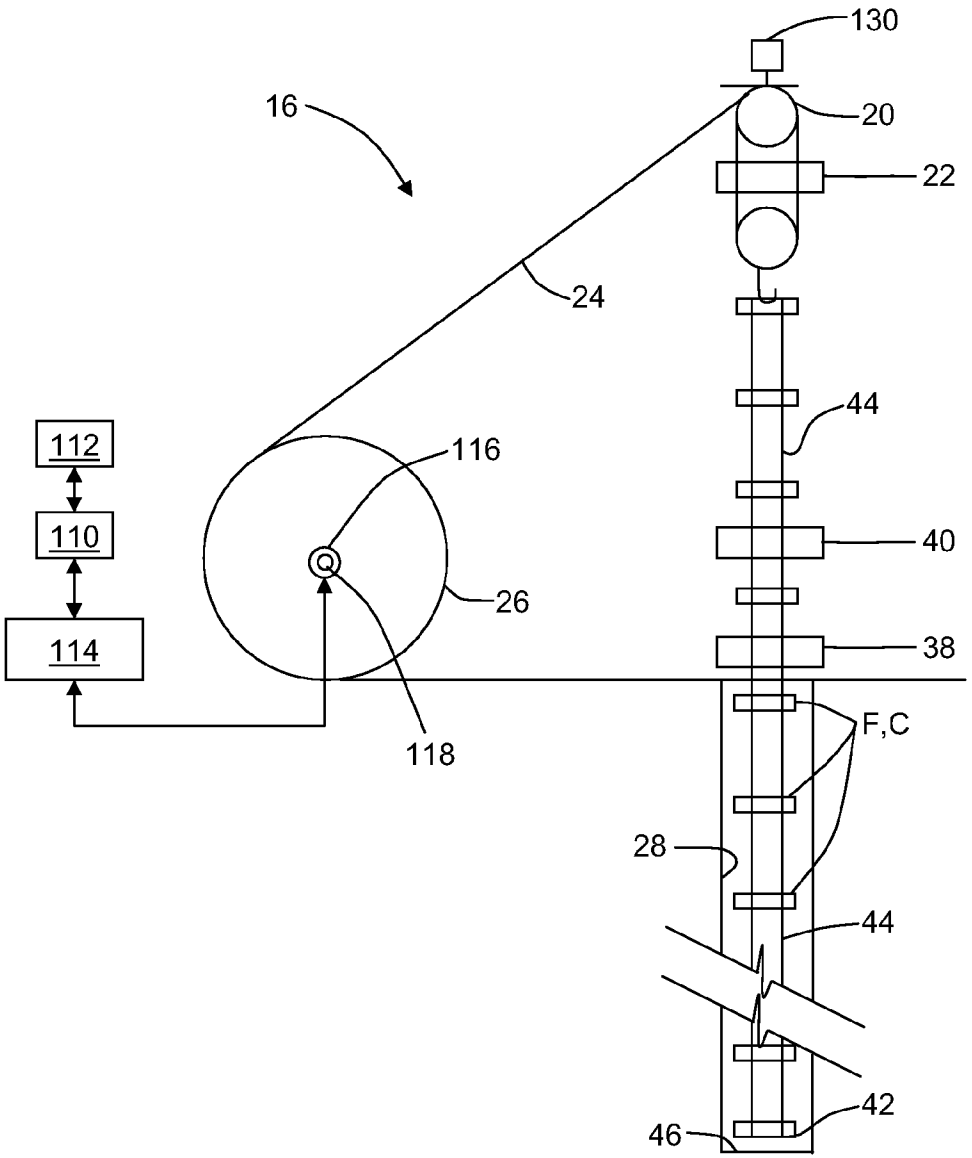
FIG. 10 is a side schematic view of a drawworks system for an embodiment according to FIG. 1, illustrating a control system for the drawworks drum and sensors for providing feedback to a drawworks PLC.

Having reference as well to FIGS. 10-15, both the drawworks and sandline systems 16, 18 are operated for maximizing speed of running in and tripping out and for adjusting cable speeds when the moving apparatus reaches point of interest or target locations. More particularly, with reference to FIGS. 10, 11 and 14A-14C, it is desirable to carefully control the drawworks and sandline cable 24 and 30 speed at the extreme ranges of motion of the cables 24, 30 and at particular target locations in the well 28 or mast 14. As shown in FIG. 10, when running tubing 44, the passage of collars C through wellhead equipment 48, a rig floor 38, tubing tongs 40 and the crown 22 are examples of points of interest for each length of tubing. Further, arrival of an end 42 of the tubing string 44 of a plurality of lengths of tubing at a bottom of the well 46 can be a point of interest. As shown in FIGS. 14A-14C, for the sandline system 18, points of interest are more related to the starting and stopping of the sandline tool 36, such as at the bottom of the well 46, at the wellhead equipment at surface 48 and at the crown 22.

Figure 6:
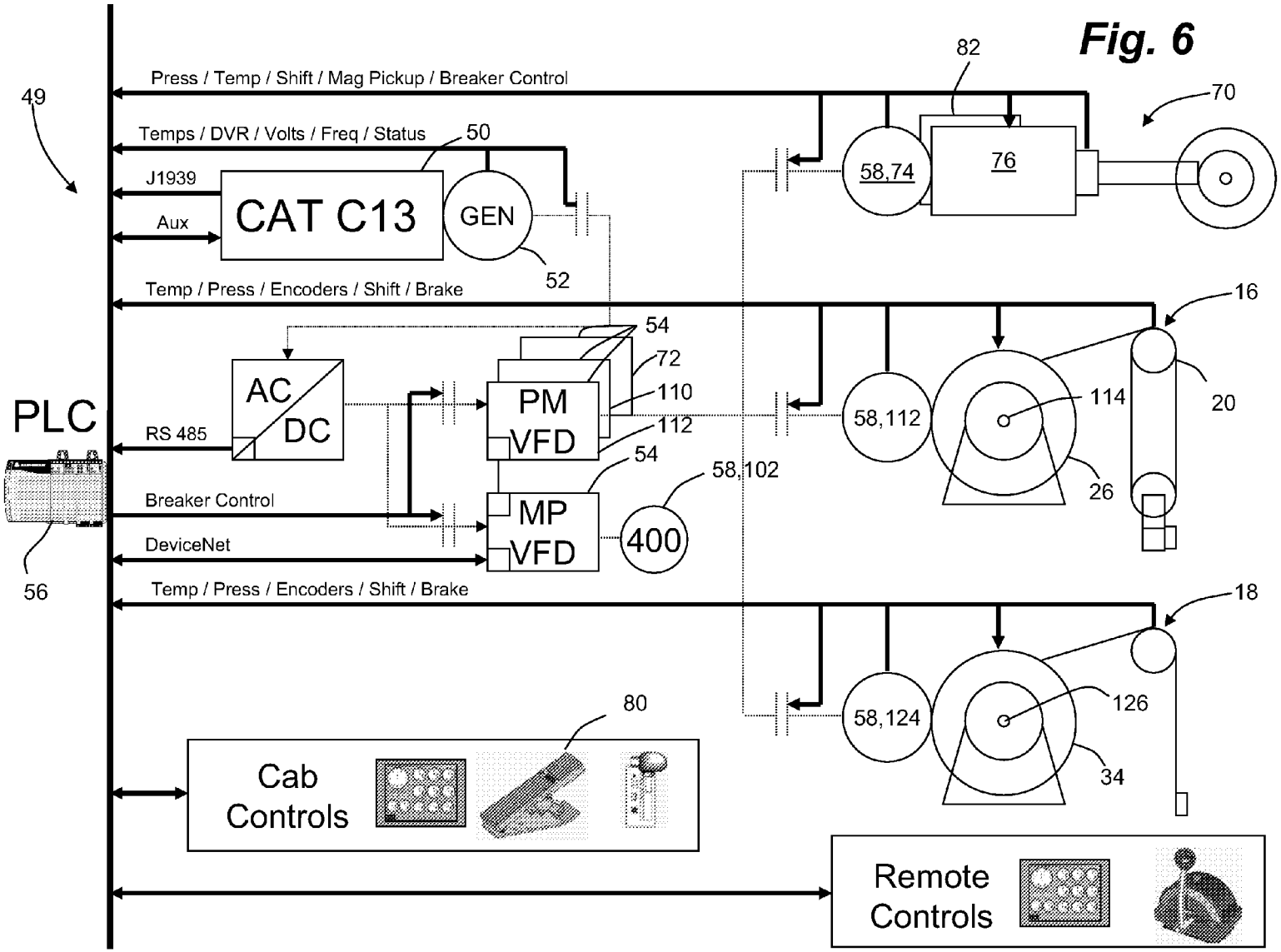
FIG. 6 is a schematic illustrating an electrical power supply and control system for an embodiment according to FIG. 1.

As shown on FIG. 6, an electrical power system 49 comprises at least one diesel engine 50, such as a diesel generator engine from CATERPILLAR™, USA which runs an AC generator 52 for generating AC electrical power. A plurality of variable frequency drives (VFDs) 54, under the control of programmable logic controllers (PLC's) 56, control a plurality of motors 58 for propulsion of the service rig 10 for transporting the rig from wellsite to wellsite and for controlling the drawworks system 16 and the sandline system 18 for raising and lowering apparatus into and out of the wellbore 28.

With reference also to FIGS. 1B-5 and 6, the power system 49, including at least the diesel engine 50, the engine-driven generator 52 and the VFD's 54 and PLC's 56 as shown in FIG. 6, are mounted on the mobile platform 12. The plurality of motors 58 are controlled by the VFD's 54. Permanent magnet (PM) motors 58 are much lighter than conventional AC motors and their use permits integration of the systems into the service rig 10 which is transportable as a single mobile unit. For the same capability, a 1000 pound PM motor can replace a 6,000 to 10,000 pound induction motor. Further, PM motors 58 do not slip and can therefore provide maximum torque at zero revolutions to very low rpm which is useful for manipulating heavy equipment or adjacent target locations. The no-slip PM motors 58 enhance the rig's ability to accurately move apparatus connected to the drawworks and sandline systems 16,18 at the various points of interest. The use of PM motors 58 and implementing an electrical propulsion system enables, for the first time, an electrical service rig 10 and results in a considerable savings in weight of the mobile platform 12, permitting transportability as a single mobile unit. In one embodiment, the motors 58 are DC brushless motors available from POWERTEC Industrial Motors, Rock Hill S.C. 29732, USA.

Also shown in FIG. 6, the braking capability of the lightweight PM motors 58 for the drawworks and sandline drums 26, 34 are supplemented with multi-disc wetted brakes 62. A series of friction discs and separator discs are alternately stacked and the stacked discs are splined alternately between the drum shafts and stationary brake housings. The disc stack is compressed via springs or hydraulic pressure to actuate the brake. Wet multi-disc brakes run in fluid such as oil which dissipates the heat generated in use. A lightweight PM motor with a multi-disc wetted brake is about 20 to 30% the weight of an induction motor alone.

Figure 7:
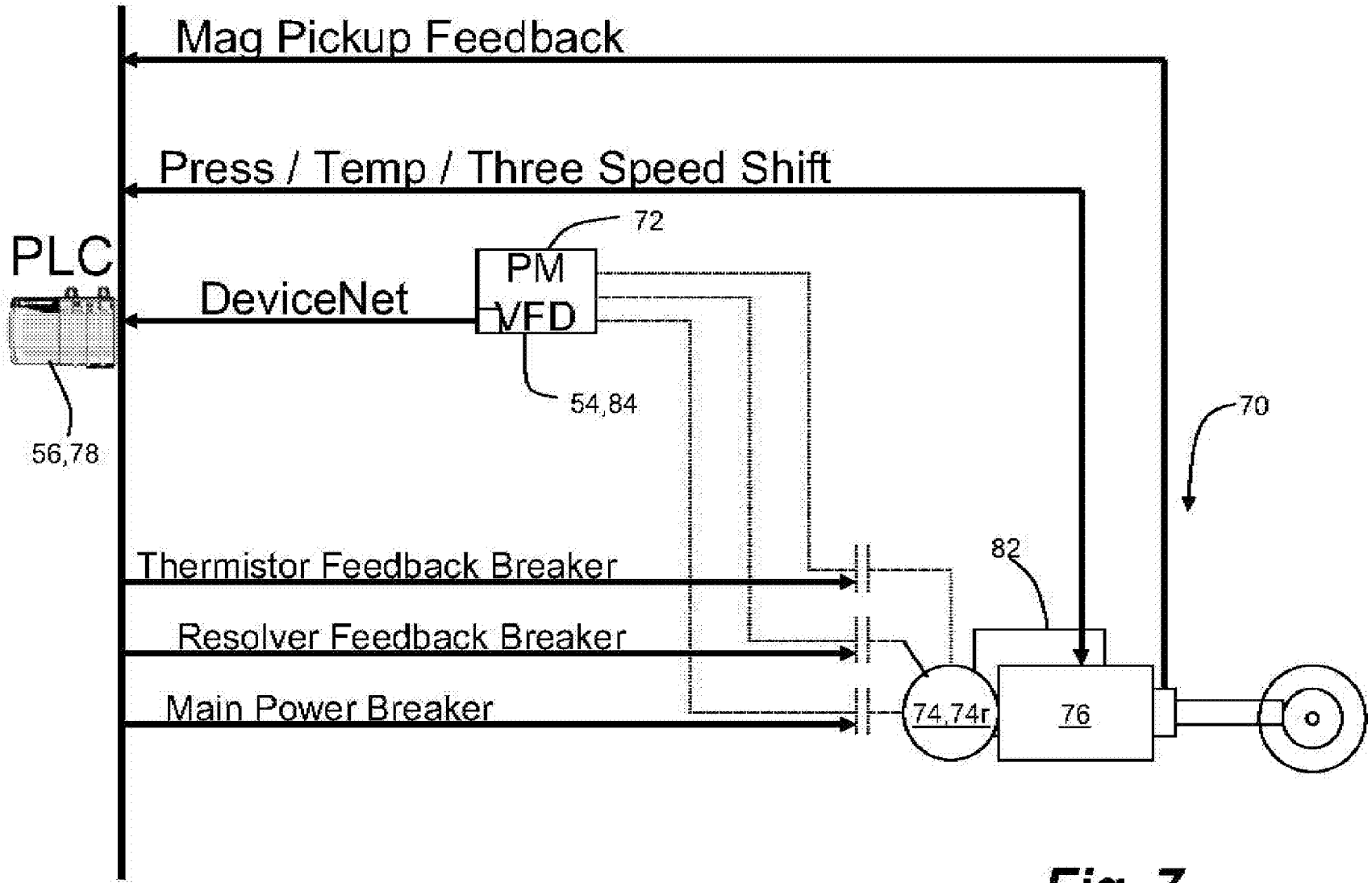
FIG. 7 is a schematic of an electrical power and control system for a propulsion system for an embodiment according to FIG. 1.
Figure 8:
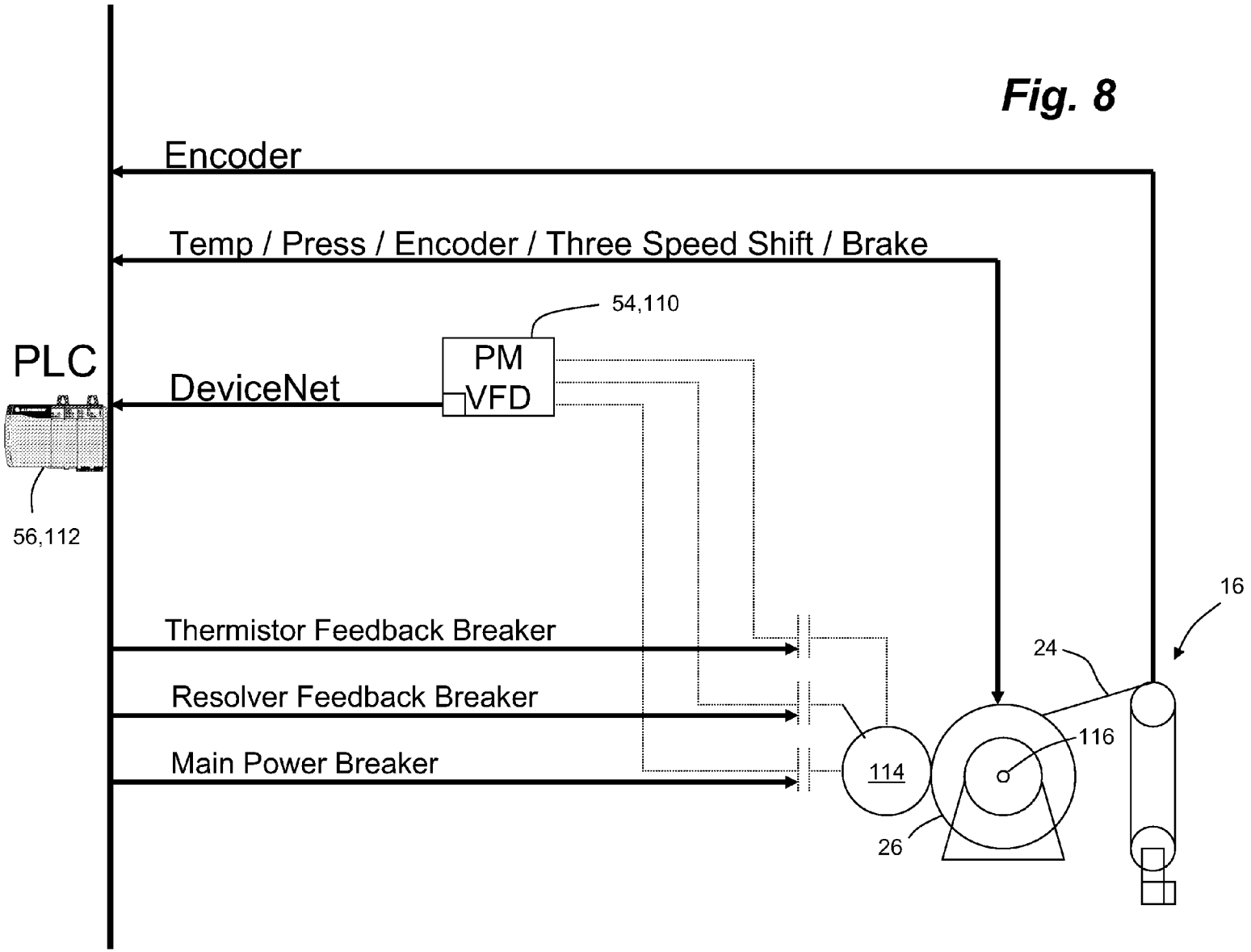
FIG. 8 is a schematic of an electrical power and control system for a drawworks system for an embodiment according to FIG. 1.
Figure 16:
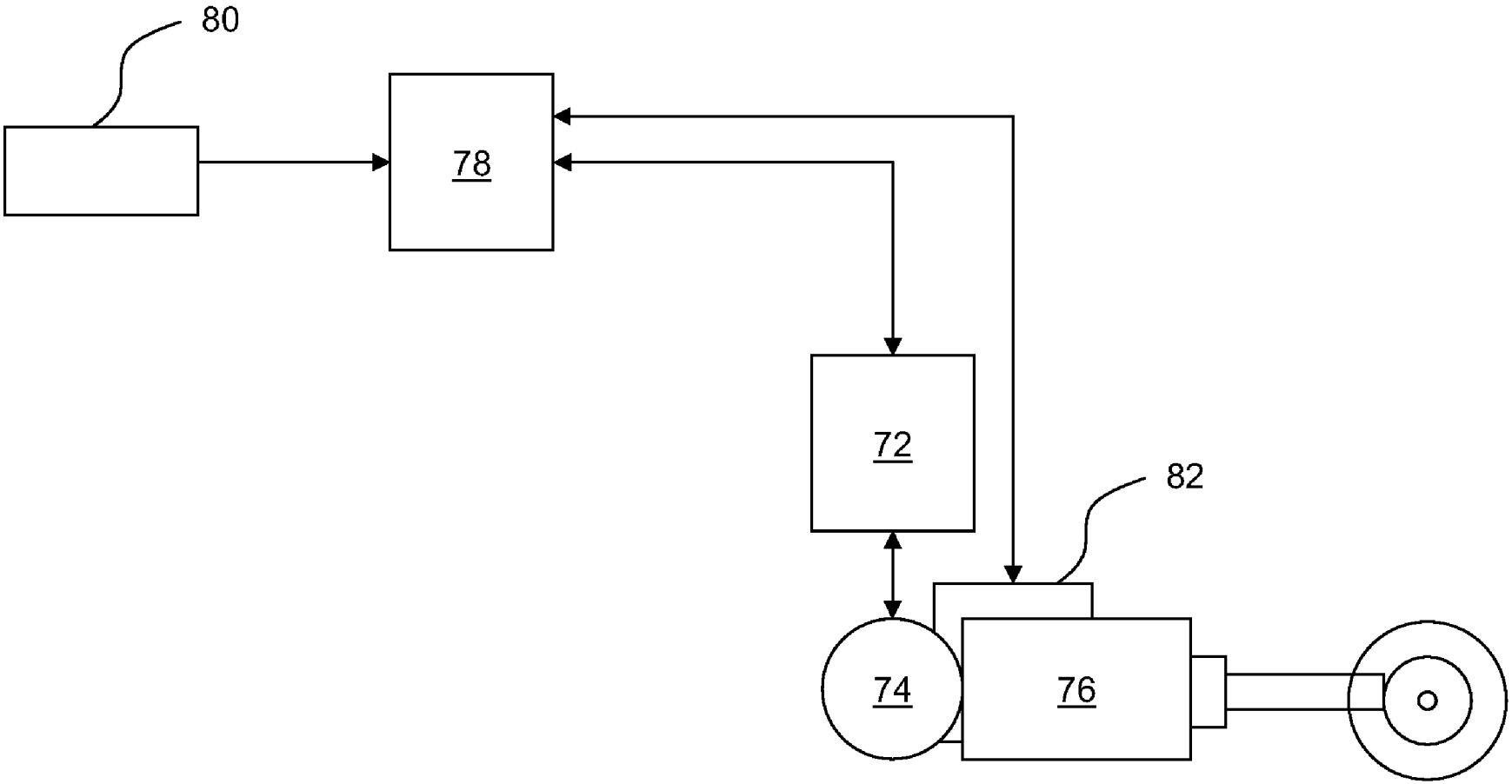
FIG. 16 is a schematic illustrating a propulsion system according to an embodiment of the invention.
Figure 17:
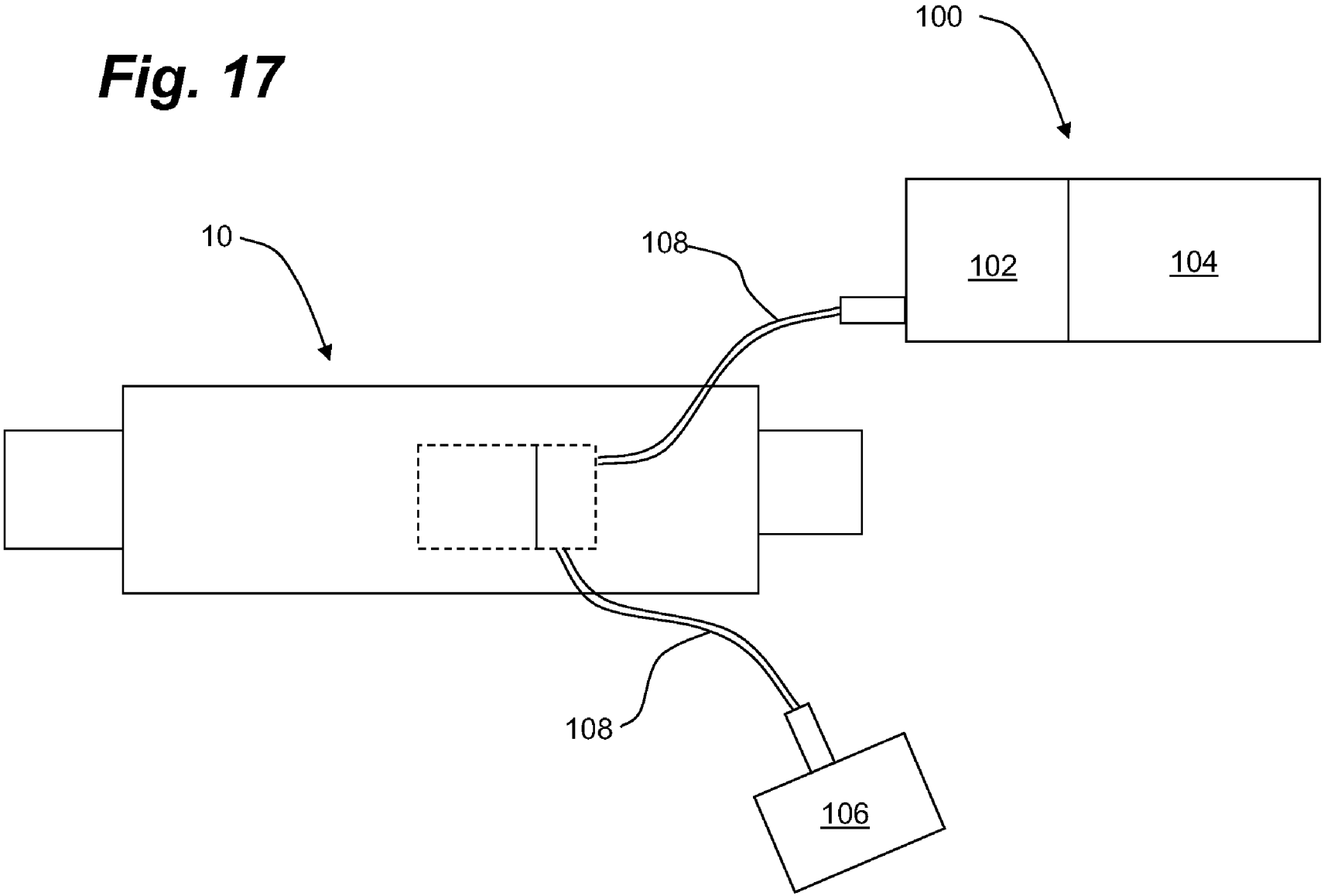
FIG. 17 is a schematic illustrating connection of a mud pump system and, optionally, hotel loads to an embodiment of the invention through one or more electrical umbilicals.

Having reference to FIGS. 6, 7 and 16, a propulsion system 70 comprises a transmission VFD 72 controlling a PM propulsion motor 74 connected to a transmission 76. The transmission VFD 72 and propulsion motor 74 are controlled through a propulsion PLC 78 which is operatively connected to an operator control 80 for achieving required road speeds. The transmission 76 can be a semi-automatic or fully automatic manual transmission. Automated shifting manual transmissions have a weight advantage over automatic transmissions. Such transmissions incorporate transmission-specific controls such as a transmission PLC 82 for coordinating with the propulsion motor 74 such as during shifting and with ABS systems during braking.

Generally, the propulsion PLC 78 receives a desired road speed signal from the operator, such as through the operator control 80. The propulsion PLC 78 communicates the desired road speed to the transmission PLC 82 for management of transmission specific control, such as gear selection and motor speed output. Ultimately, the transmission VFD 72 receives motor speed set points for operation of the propulsion motor 74. In one embodiment, the transmission PLC 82 returns the motor speed set point to the propulsion PLC 78 for control of a propulsion VFD 84. The transmission PLC 82 and propulsion PLC 78 act in concert to control shifting of the transmission in response to feedback from the operator.

In one embodiment, the transmission 76 has a plurality of gears to permit maximum gradeability. An example of such a semi-automatic transmission is an AS Tronic™ transmission (trademark of ZF Friedrichshafen AG, Germany, www.zf-.com,) which implements a shift strategy using a non-synchronized three-stepped basic transmission with a synchronized range and splitter group and 12 pneumatically controlled gear steps. In particular the AS Tronic™ transmission already incorporates a sophisticated electronic interface between the transmission 76, various power plant controllers, operator accelerator 80, brake and ABS systems.

Figure 3:
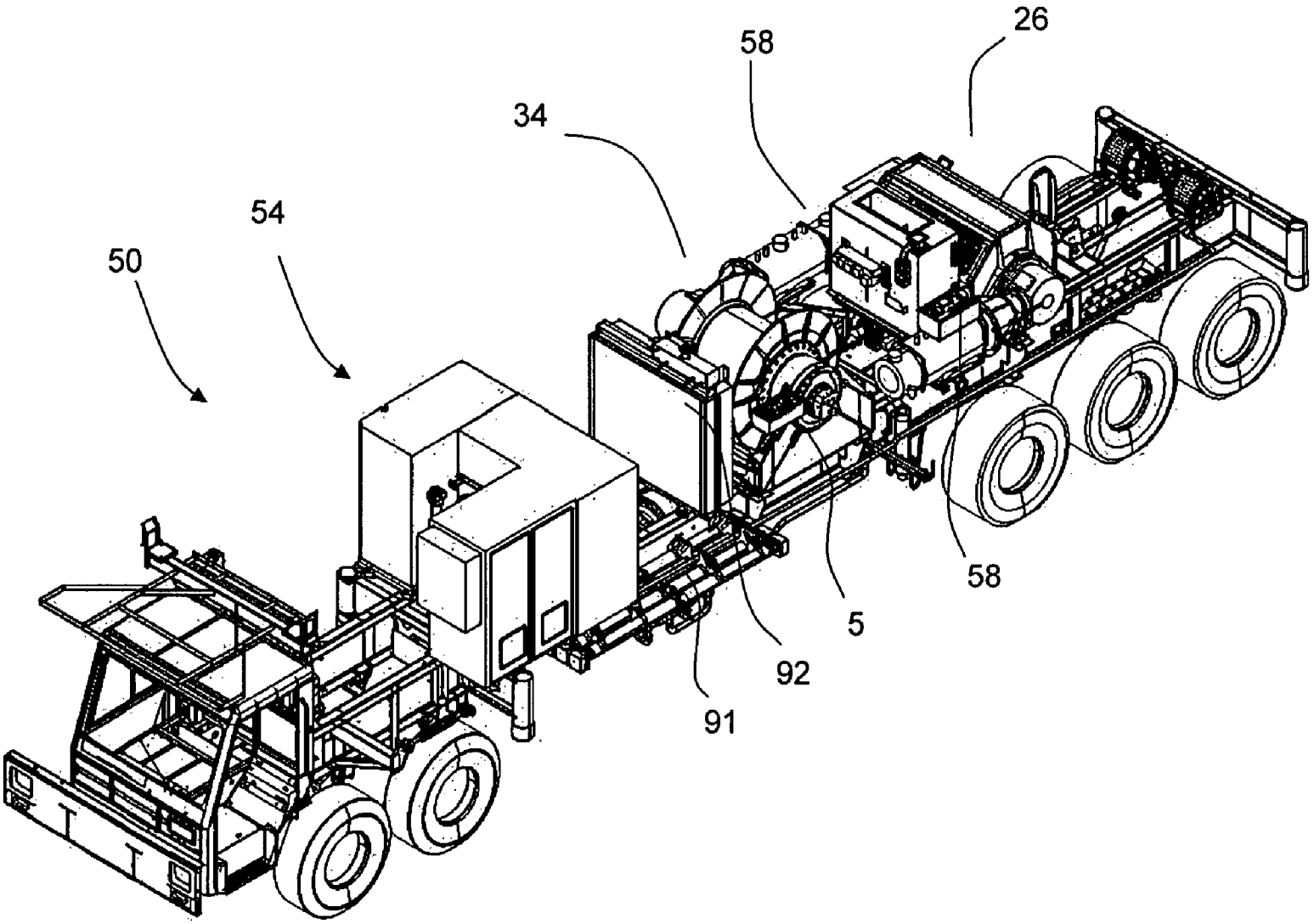
FIG. 3 is a left perspective front view of the service rig of FIG. 1, the mast and railings removed for clarity.
Figure 4:
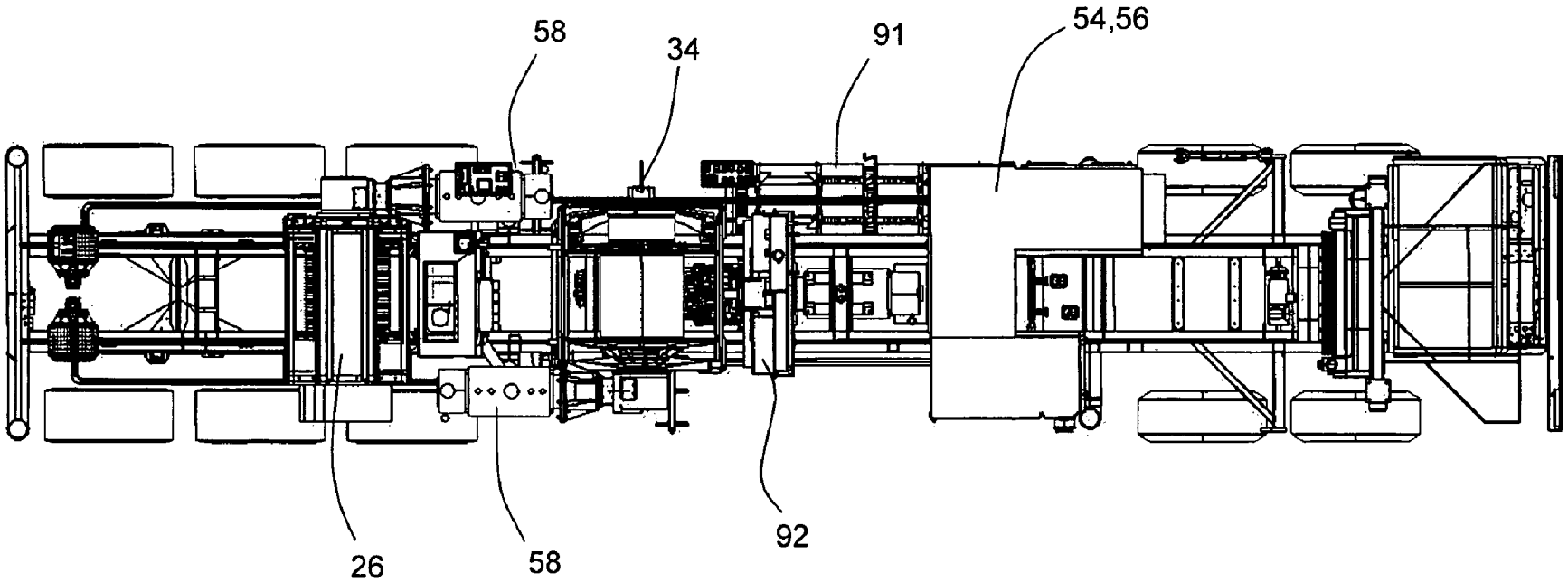
FIG. 4 is a plan view according to FIG. 2.
Figure 5:
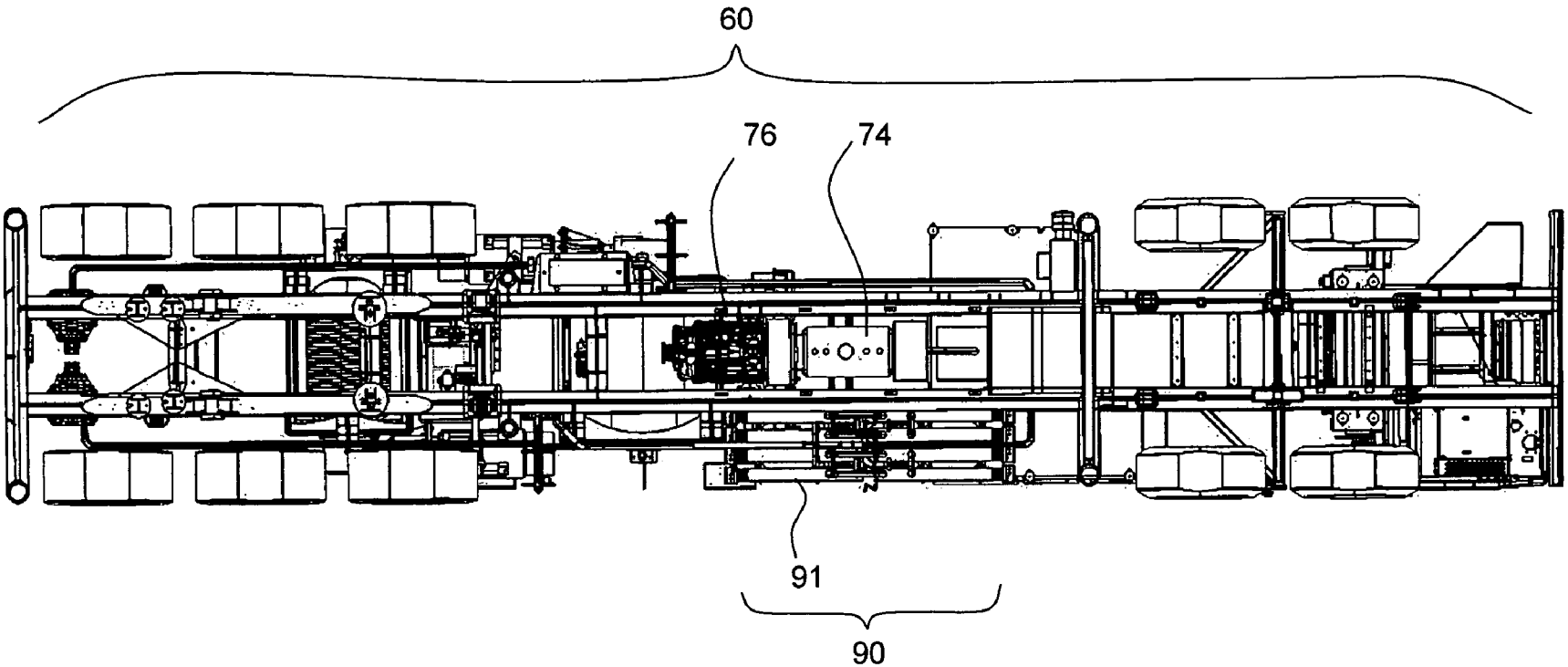
FIG. 5 is a bottom view according to FIG. 2, an engine, generator and differential removed for clarity.

With reference to FIGS. 3, 4 and 5, the mobile platform 12 of the service rig 10 implements an electrical motor braking system 90 which, in embodiments of the invention, comprises a hybrid braking system for combining braking from the propulsion motor 74 with conventional braking, such as ABS brakes. In embodiments of the invention, dynamic braking and regenerative braking with electrical storage are implemented. When regenerative braking is not feasible, such as when the electrical storage such as capacitors is fully charged, dynamic braking utilizes a resistor bank 91 and cooling system 92 to dissipate braking energy. The propulsion PLC 78 controls how much regenerative braking 74*r* or dynamic braking is applied to supplement transmission range selection. The operator is typically provided with a selector switch which has an off, medium and high option and which is adaptive depending on the propulsion motor rpm. For example, as regenerative braking reaches maximum, the transmission 76 will automatically shift gears to lessen the regenerative or dynamic braking load. Further, the conventional anti-lock braking systems (ABS) provide signals to the propulsion PLC 78 when the ABS braking systems are operated.

The engine and generator 50,54 of the service rig 10 is capable of incorporating all the power needs for onboard propulsion, drawworks 16, sandline 18 and further, for off-platform needs, including a mud pump system 100 and hotel loads.

Particularly advantageous is the ability to power the mud pump system 100, which is necessarily separately transportable, having the mud pump motor 102 and mud tanks 104. In an embodiment of the invention, the mobile platform generator 52 also powers the mud pump motor 102. A power umbilical 108 or two, depending on the electrical cabling requirements, is releasably coupled with the mobile platform 12. The mud system can utilize mud pumps driven by an asynchronous induction motor 102 and instrumentation can be directed back to the service rig 10 including mud levels, temperatures and motor temperatures. Mud pumps are typically positive displacement plunger pumps and a stroke counter can enable calculation of the volume of mud being pumped. Power can also be provided through one or more umbilicals 108 for hotel loads 106, such as lighting, heating and the like.

A simple hydraulic power takeoff (not shown) from the engine 50 can provide auxiliary hydraulic power for lubricators, for the drawworks and sandline systems, power tongs, mast raising and telescoping hydraulics, leveling jacks and deck winches.

The collapsible mast 14 is typically mounted at a rear 15 of the platform 12 so as to be moveable between a lowered transport position over the rig's platform 12 and in a raised position, cantilevered over a wellhead connected to the wellbore 28 for performing a variety of servicing operations. The mast 14 is generally tilted through one or more hydraulic rams connected between the mast 14 and the platform 12 and powered by a hydraulic pump.

In an embodiment of the invention, as shown in FIGS. 6, 8 and 10-13, the drawworks system 16 comprises a drawworks VFD 110, under the control of a drawworks PLC 112, and a PM drawworks motor 114 operatively connected to the drawworks hoist drum 26. The drawworks motor 114 is connected to the drawworks hoist drum 26 through a drawworks drum shaft 116 and includes a gear reducer, typically a three-speed gearbox. The drawworks hoist drum shaft 116 further includes an encoder 118 for providing position information for the hoist cable 24. Additional instrumentation includes gearbox shift and brake controls and sensors for providing feedback regarding drawworks system health including temperature.

Having reference to FIGS. 9, 14A-14C and 15, the sandline system 18 comprises a sandline VFD 120, under the control of a sandline PLC 122 and a PM sandline motor 122 operatively connected to the sandline drum 34. The sandline motor 122 is connected to the sandline drum 34 through a sandline drum shaft 124. The sandline drum shaft 124 includes an encoder 126 for providing position information for the sandline cable 30. Additional instrumentation includes brake controls and sensors for providing feedback regarding sandline system health, including temperature.

Figure 9:
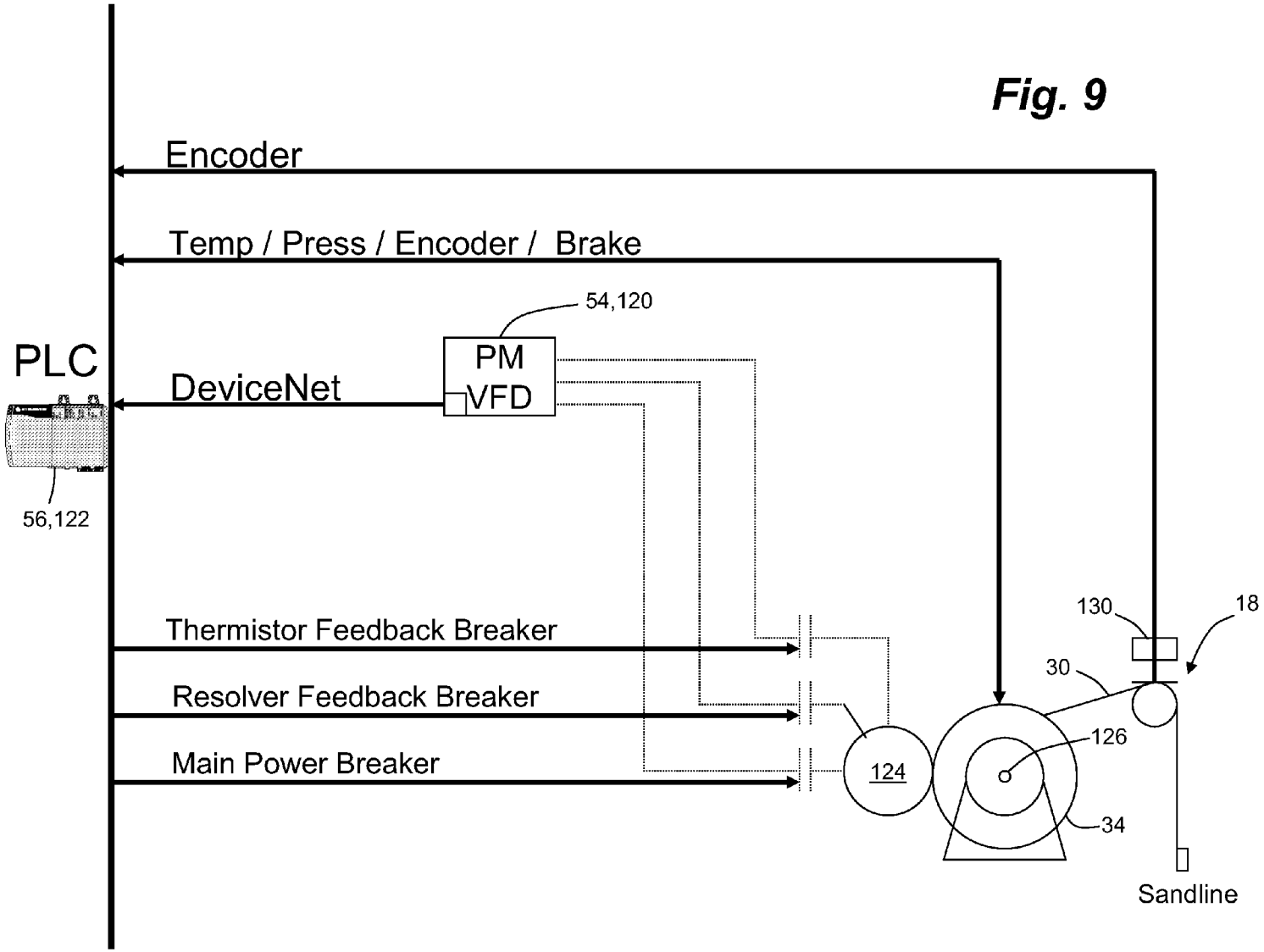
FIG. 9 is a schematic of an electrical power and control system for a sandline system for an embodiment according to FIG. 1.

In an embodiment of the invention, the mast crown 22 includes encoders for additional position control of the drawworks and sandline cables 24, 30. As shown in FIGS. 9 and 10, load sensor 130 enables adjustment for drawworks cable 24 or sandline cable 30 stretch and provides online calibration to better determine proximity to points of interest. Sandline cable 30 is particularly affected by load and stretch, largely due to the length of cable 30 payed out. Parameters required by the sandline PLC 122 are a load and a number of layers of sandline cable 30 on the sandline drum 34. The sandline drum 34 typically has a fixed diameter and the length of sandline cable 30 wrapped about the first layer is readily calculated from the circumference and the rotation encoder 128. However, the drum's effective diameter changes, each wrap or layer of cable 30 requiring adjustments in the length of cable 30 payed out or reeled in per revolution of the drum 34. The cable diameter and the calibration process from crown 22 to rig floor 38 is typically input to the sandline PLC 122.

As previously stated, the PM motors 58 are used for manipulating heavy equipment and embodiments of the invention are particularly suited for fine motor control for manipulating the apparatus adjacent points of interest or target locations. The target locations may or may not be on the service rig. Typically the target locations are fixed and are relative to either the well service rig 10 or the wellbore 28. For example, the target locations relative to the wellbore 28 may be the bottom of the wellbore 46, a wellhead or a lubricator 48 and the target locations relative to the rig 10 may be the rig floor 38, power tongs 40, and crown position 22.

Additionally, conventional tubing logs are maintained to log the running in and out of the production string to maintain a relationship between a distal end 42 of production string 44 and bottom 46 of wellbore 28 in the overall operating system. As the service rig 10 operates, tubing section lengths are tallied as they are run into and out of the wellbore 28 for comparison with known target locations, like the bottom 46 of the wellbore 28. The drawworks PLC's 112 is typically programmed with the known target locations, such as the well bottom 46, which may be derived from previous tubing tallies or well logging tools.

Further as shown in FIGS. 11 and 14A-14C, flag locations F are utilized to assist with running apparatus such as tubulars 44 or tools 36 into the wellbore 28 and are typically locations on the particular tool itself. The flag locations F are not fixed relative to the wellbore 28 or the rig 10 and move with the apparatus. Examples of flag locations F are the plurality of collars C between tubulars in a tubing string 44 or a top end 35 and bottom end 37 of a sandline tool 36, such as a swabbing tool.

In embodiments of the invention, prior to performing a service on a wellbore 28, a calibration is performed wherein calibration signals are sent to either or both of the drawworks PLC 112 and sandline PLC 122 as the apparatus is manipulated by the operator to the various target locations T. The calibration signal is sent by a switch to indicate correspondence between the target location T, such as the rig floor 38 and a flag location F, such as the tubing collar C, when a tubing collar C is aligned at the rig floor 38.

Figure 11:
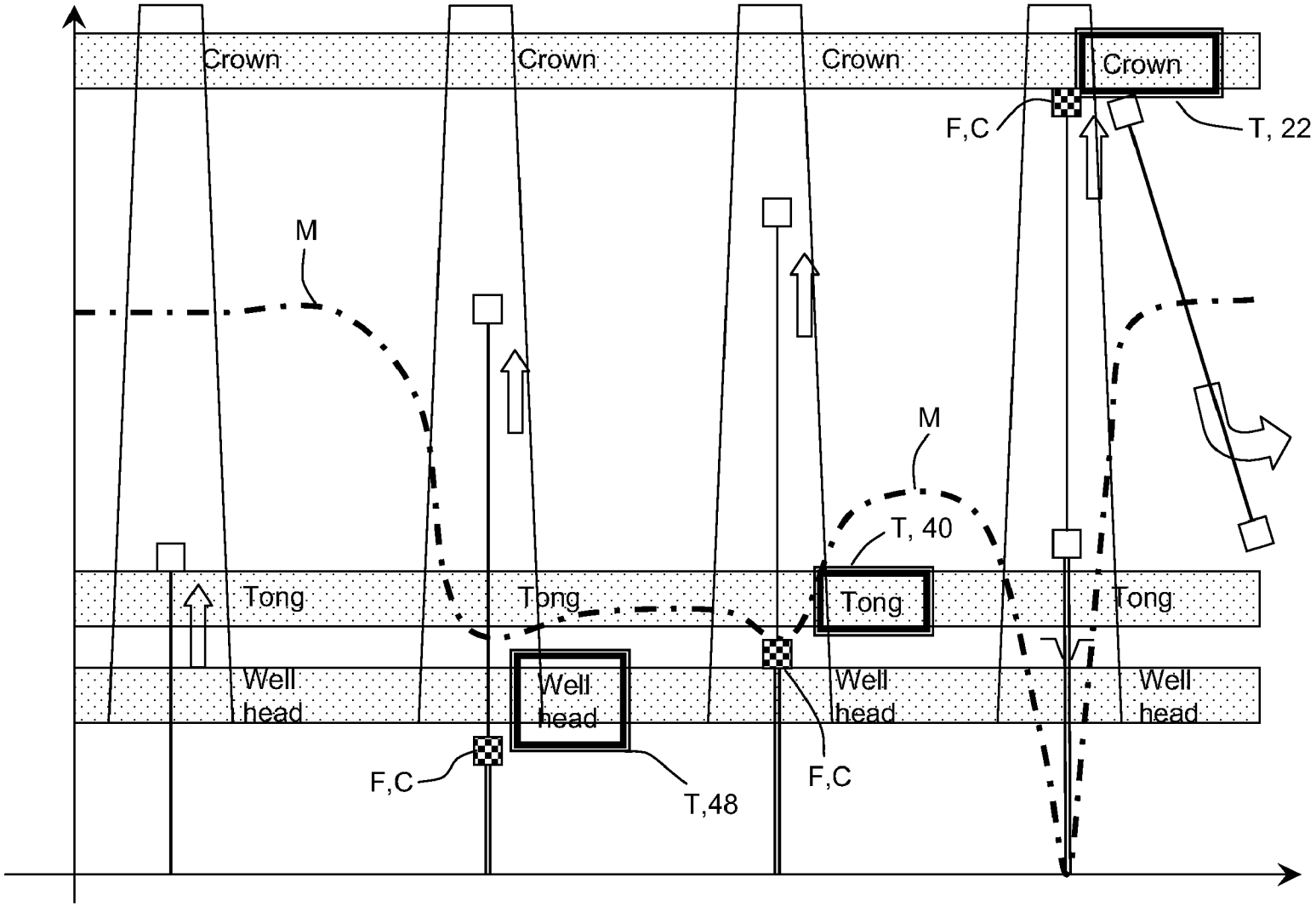
FIG. 11 is a schematic illustrating operational positions of the drawworks of FIG. 10 wherein drawworks blocks are raised and lowered for positioning a tubing string at target locations and for positioning flagged collars of the tubulars a relative to at least some of the target locations.
Figures 14A, 14B, 14C:
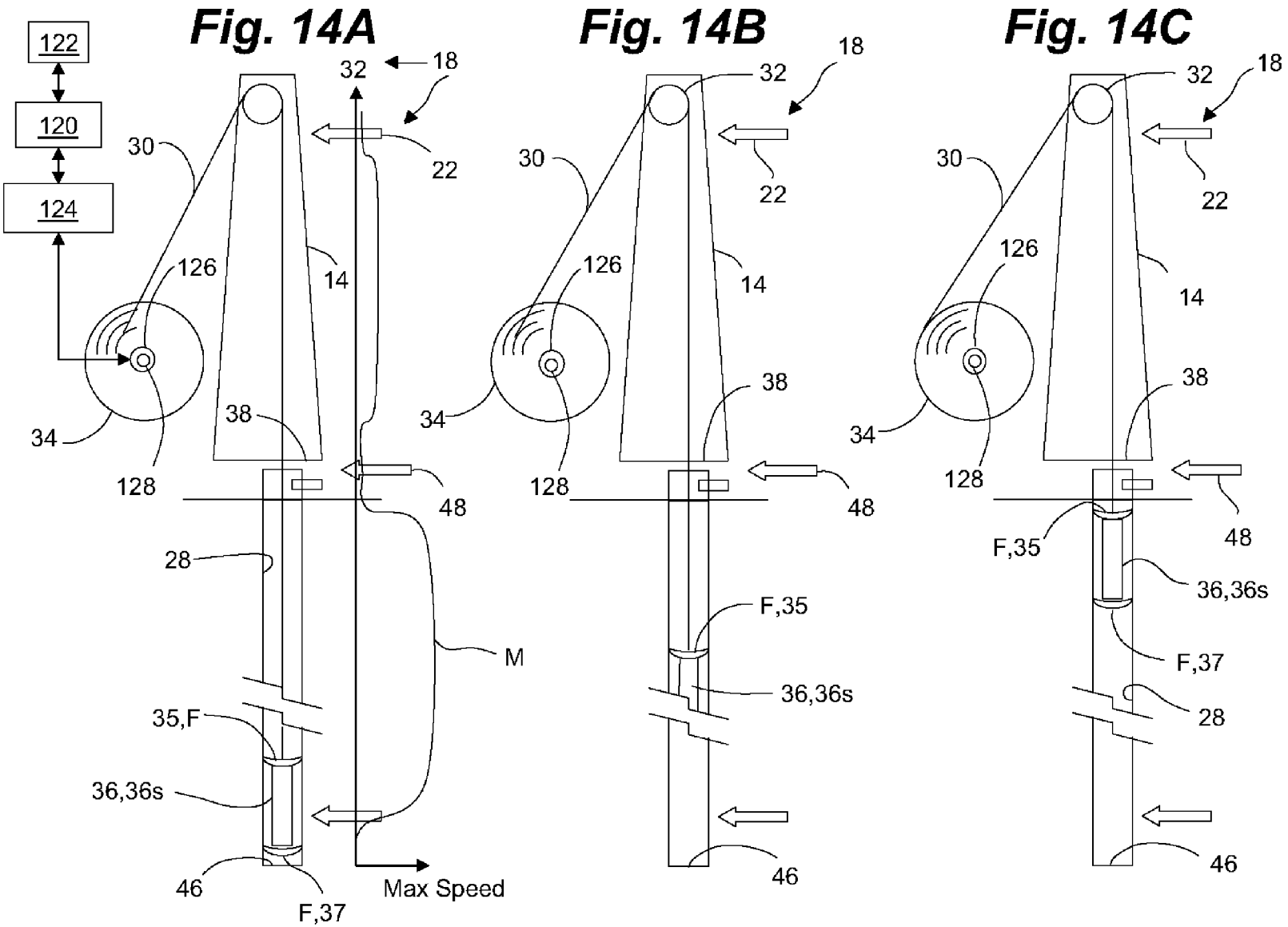
FIGS. 14A-14C are side schematic views of a sandline system for an embodiment according to FIG. 1, illustrating a control system for the sandline drum and sensors for providing feedback to a sandline PLC, more particularly

In use, to minimize well servicing duration and cost, it is preferred to operate the drawworks and sandline systems 16,18 at a maximum speed whenever possible. However, the drawworks and sandline PLC's 112,122 act to control the speed of the drawworks and sandline PM motors 114,124 for reducing a maximum speed setpoint M to a slower speed when a flag location F is within a preset window distance of the target location T. In this way, the PLC's 112,122 control the operation for ensuring the apparatus is not bottomed out in the wellbore 28, topped out in the crown 22 or pulled through wellhead equipment 48 at speeds which may result in damage to any of the equipment. As shown in FIG. 14A, typically, the maximum speed setpoint M at which the sandline cable 30 is run in or tripped out is much faster than that of the drawworks blocks 20. In accordance with the faster speeds, an appropriate window distance for the sandline system 18, such as about either the bottom of the wellbore 46 or wellhead equipment 48, may be as much as 60 feet. As shown in FIG. 11, the drawworks cable 24 is run at slower speeds and therefore an appropriate window for the drawworks system 18, such as about the wellhead equipment 48 or at the rig floor 38, power tongs 40 or crown 22, may be about 2 feet. Speed of drawworks cable 24 deployment typically varies depending upon the weight of the tubing string 44 attached thereto and may be, for example, about 2 m/s for a 10,000 pound tubing string to about 1 m/s for tubing strings having a weight of about 100,000 pounds.

In embodiments of the invention, an operator utilizes a conventional appearing control panel which includes both a drawworks speed joystick and a sandline speed joystick. The drawworks and sandline PLC's 112,122 reduce the maximum speed setpoints by reducing the "gain" so that operator joystick maximum is reduced at target locations T from the higher or maximum speed setpoint used between target locations T. In other words, at the target locations T, the joystick maximum is set at the target location maximum for slowing the speed.

With reference to FIGS. 10 and 14A, embodiments of the invention utilize a number of conventional sensors to provide feedback to the PLC's 56 regarding a variety of operational parameters which assist with controlling the rig systems. Rotation of the driven shafts 114,126 of the drawworks hoist drum 26 and sandline drum 34 are monitored using motor encoders 118,128, typically dual output shaft encoders and resolvers, for monitoring motor 114,124 current draw, torque required to move the motor 114,124 and power utilized by the motor 114,124. Feedback from the drawworks shaft encoder 118 coupled with the no-slip PM motor 114 permits accuracy of about ⅛" of movement of a heavy tubing string 44 using the multiline blocks 20.

Further as shown in FIG. 10, the drawworks deadline or block load sensor 130 provides feedback to the drawworks PLC 112 regarding the load on the drawworks system 16 for calculating alterations in tubing parameters, such as tubing stretch. Corrections to account for the alterations in tubing parameters can then be incorporated into the operational system, such as to adjust flag locations F relative to the tubing string 44.

Further, as shown in FIGS. 14A-14C, sandline sensors typically comprise at least the sandline shaft encoder 128 for providing positioning feedback to the sandline PLC 122 for determining positioning of apparatus, such as a swabbing tool 36*s*, connected to the sandline cable 30 relative to the fixed target positions T and the flag positions F.

Dual output encoders are typically used to provide a redundancy in the signal to the various PLC's 56. Two sets of internal electronics provide the redundancy and if, for some reason, the two signals do not agree, the PLC's 56 will automatically slow the speed of the driven drawworks or sandline shafts 116,126 from the maximum speed to the slower target location maximum or other minimum speed to permit verification of location. Further, resolvers may be added to the PM motors 58 as an additional redundancy to compare against encoder feedback to ensure accurate positioning. Once the position has been verified or the problem resolved, the PLC's 56 can then reset the speed to the maximum running speed.

Conventional switches can be used, as previously described, to permit calibration of the correspondence between a fixed target location T and a flag location F. The switches may be used in isolation to signal to the drawworks or sandline PLC 112, 122 the location of the relative target and flag positions T,F or can be used in at least a pair, for example the floor location 38 and the crown location 22, for calculating drawworks or sandline cable 24,20 pay-out and reel-in distances for a particular drum. Additionally, cable diameter may be used to calculate variable correspondence between drum encoder 118,128 revolutions and actual distances payed out or reeled in.

Figure 12:
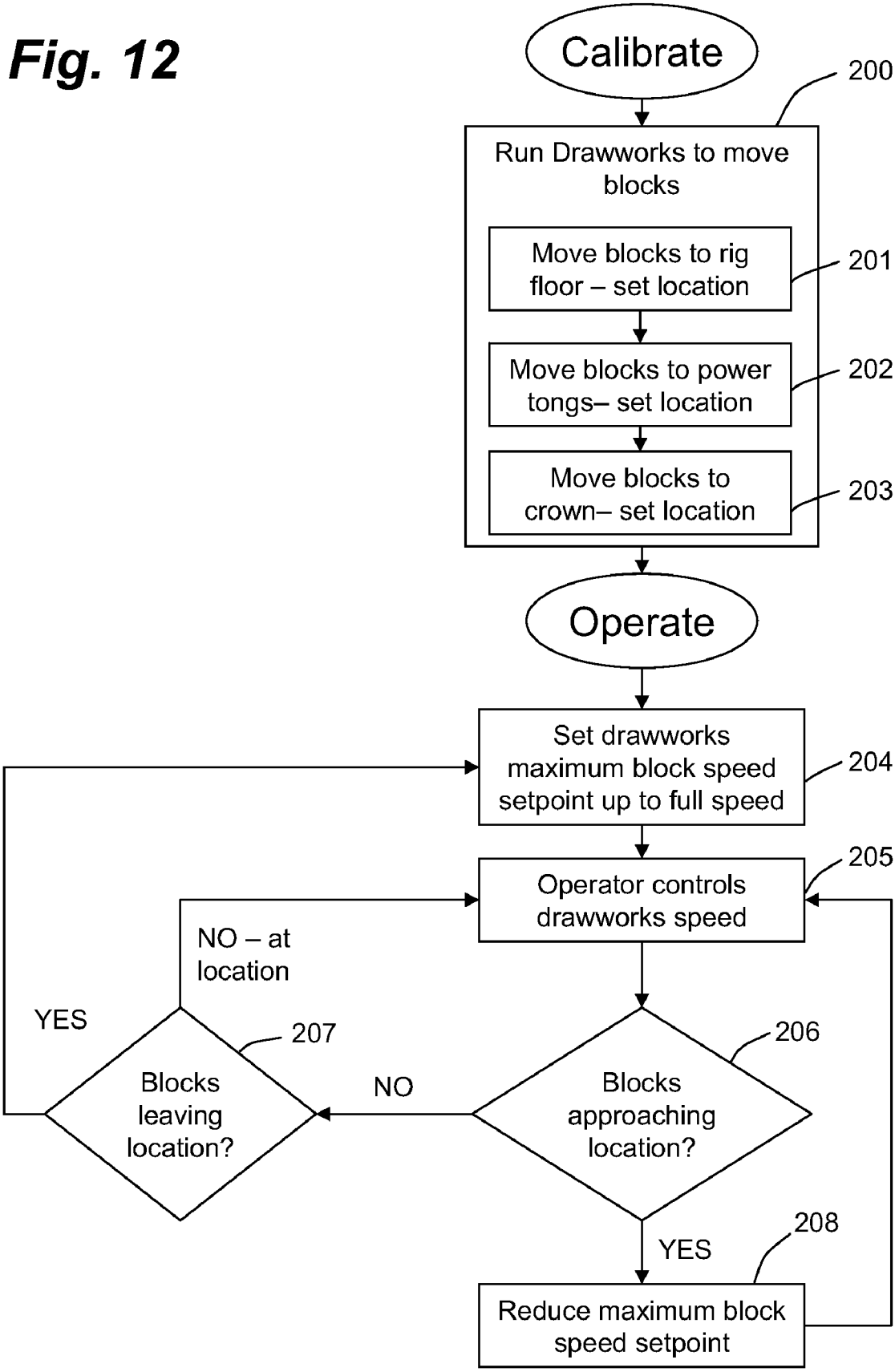
FIG. 12 is a flowchart illustrating a calibration operation for the drawworks of FIG. 10 and for subsequent raising and lowering of the blocks of the drawworks for tripping apparatus into and out of the wellbore.
Figure 13:
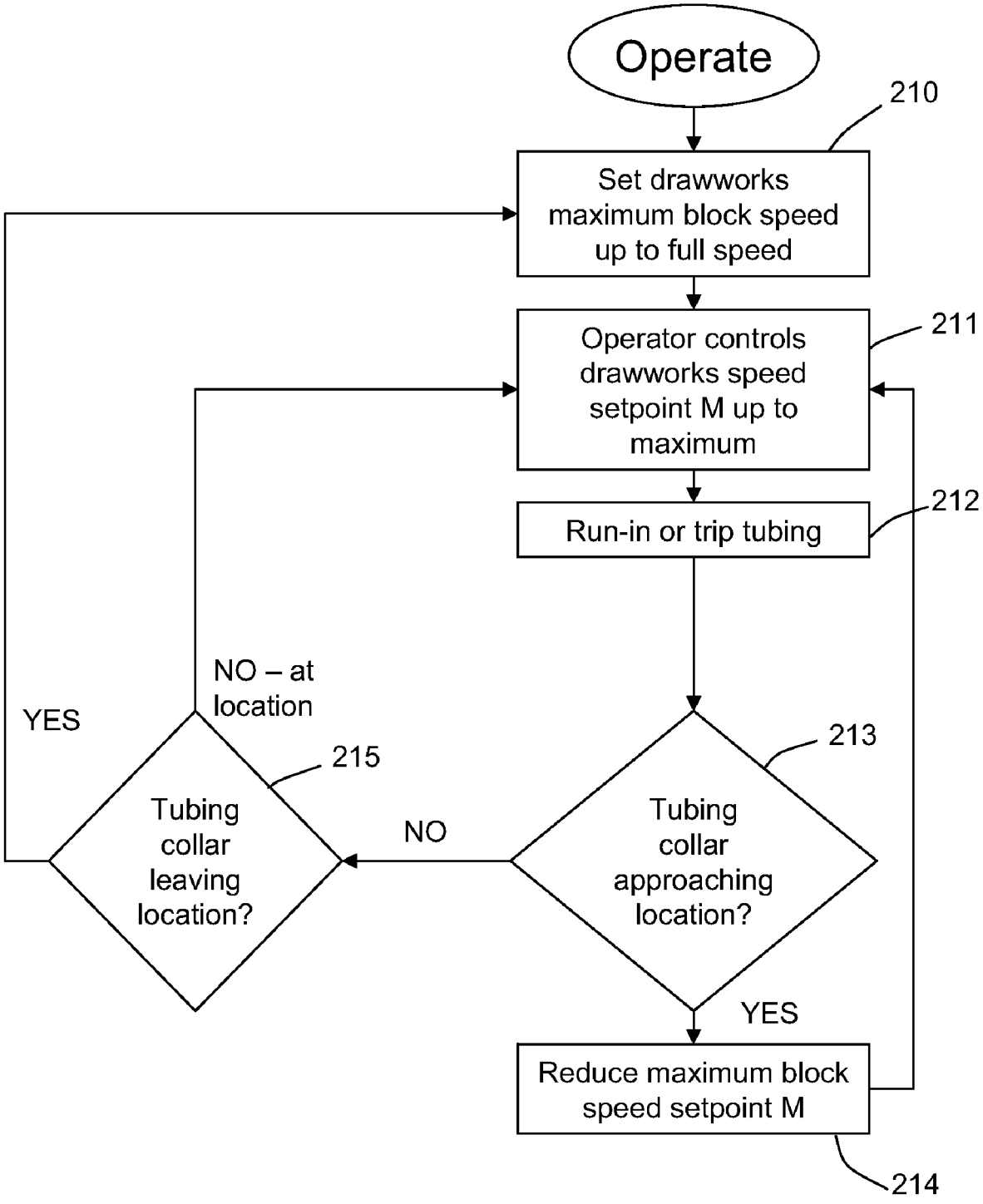
FIG. 13 is a flowchart illustrating raising and lowering tubulars using the drawworks system of FIG. 10 and for positioning collars of the tubulars at target locations relative to the rig and the wellbore.

Having reference to FIGS. 10, 12 and 13, the blocks 20 of the drawworks system 16 are raised and lowered by the drawworks cable between the rig floor 38, the power tongs 40 and the crown 22 of the rig 10 for moving sections of tubulars 44 of fixed length into and out of the wellbore 28. Said movement permits operators on the floor 38 of the rig 10 to make up the sections at the threaded collars C for running in or breaking out the sections at the threaded collars C when tripping out.

Having reference to FIG. 12, at block 200, prior to running the tubulars 44, the drawworks system 16 is first calibrated by moving the drawworks blocks 20 to each target locations T, being at block 201 the rig floor 38, at block 202 the power tongs 40 and at block 203, the crown 22. The operator sets the location by pressing a switch and the location information is provided to the drawworks PLC 112 as previously described. The block 20 location is coordinated with the sections of tubulars 44 for locating collars C.

Once the system has been calibrated, the tubing string can be run in or tripped out. For ease of description, the process of running in is described, the process of tripping out being essentially a reverse operation. At block 204, the drawworks maximum speed setpoint M is set to run in the tubing at the maximum block speed. At block 205, the operator controls the joystick to run at up to the maximum speed. At blocks 206 and 207, the drawworks PLC 112 is aware of the tubing string tally and monitors the location of the blocks 20 and flag locations F relative to the target locations T in the rig 10 through feedback from the encoders 118, 130. As the blocks 20 approach the target locations T at block 206, the drawworks PLC 112 automatically reduces the gain on the joystick at block 208 which reduces the setpoint M and slows the drawworks speed to ensure safe passage of the flag location F. As the blocks 20 leave the target location T, at block 207, the drawworks PLC 112 sets the speed setpoint M to the maximum block speed, as shown at block 204. The drawworks PLC 112 continues to operate at the maximum block speed until such time as the blocks 20 approach another target location T.

As shown in FIG. 13, when running tubulars, flag positions F, particularly the position of the tubing collars C, must be monitored to ensure the tubing collars C are not moved through the wellhead 48 at maximum speed. The drawworks PLC 112 is programmed with the average length of a tubular and the preset window distance so as to account for deviations in the length of the tubulars between collars C. The encoders 118 on the drawworks hoist drum shaft 116 and the drawworks motor 114 provide feedback to the drawworks PLC 112. The data is corrected for any cable and tubing stretch through feedback from the block load sensor 130 to determine more precise flag locations F, in this case the location of the collars C.

As shown at block 210, the drawworks PLC 112 sets the drawworks at maximum speed. At block 211, the operator controls the joystick to run at the maximum speed during either running in or tripping out of the tubulars 44, shown at block 212. At block 213, as the preset window distance approaches the target location T, the drawworks PLC 112 automatically reduces the speed setpoint M at block 214 from the maximum block speed by automatically reducing the gain for the joystick and runs the drawworks at the reduced target maximum speed until the preset window distance has passed the target location T as shown at block 215. The drawworks PLC 112 then automatically increases the running block speed setpoint again to the maximum block speed at block 210 until the next preset window distance approaches the target location T.

Having reference to FIGS. 14A-14C and 15, in a sandline operation, such as running in and tripping out a swabbing tool 36*s*, target locations T for calibration, typically the rig floor 38 and the crown 22 are programmed into the sandline PCL 122, much like the drawworks 16, blocks 20 and tubing string 44 calibration. The operator presses a switch as the sandline cable 30 is deployed to each of the rig target positions 38, 22. An optional mid-mast position may also be used for the calibration. Operational target locations T of the service rig 10, such as the bottom of the wellbore 46 (FIG. 14A) and a top of the wellbore or wellhead 48 (FIG. 14C) are calculated and programmed into the sandline PLC 122. The sandline PLC 122 is also programmed with preset slowdown windows of distance from the top of the wellbore or wellhead 48 and the bottom 46 of the wellbore 28.

For ease of description, tripping out of the swabbing tool 36*s* is described, the running in being essentially a reverse operation. As shown in FIG. 14A, as the sandline cable 30 is raised from the bottom 46 of the wellbore 28, the sandline drum 34 is run at a set maximum speed. As the sandline-deployed swabbing tool 36*s* approaches the preset window distance from the top of the wellbore 48, the sandline PLC 122 automatically reduces the speed of the sandline motor 124 and the sandline cable 30 and swabbing tool 36*s* are raised slowly to the surface to avoid pulling the swabbing tool 36*s* through the wellhead 48 at maximum speed.

Figure 15:
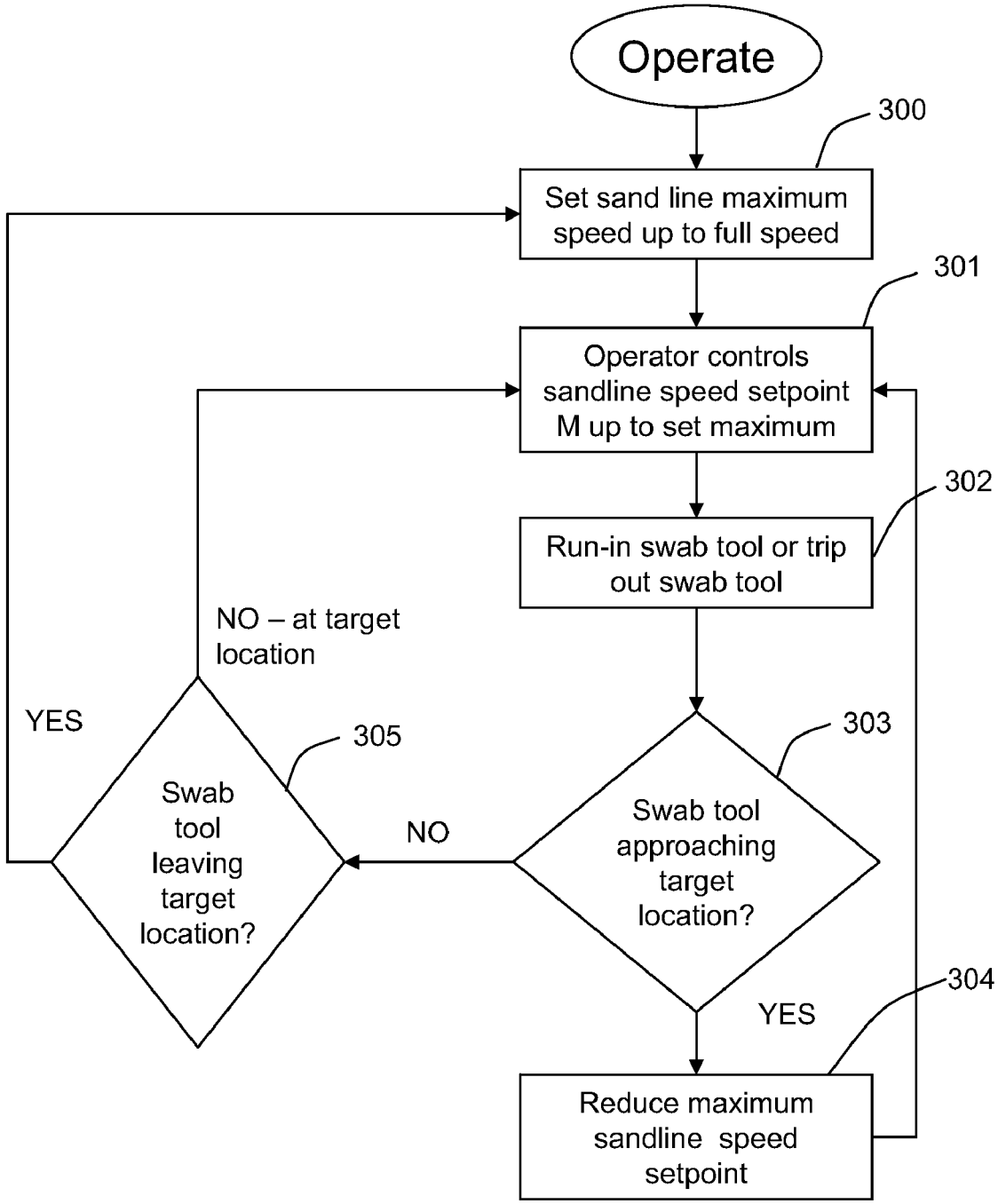
FIG. 15 is a flowchart illustrating a process for running in or tripping out a swabbing tool from a wellbore using the sandline system of FIGS. 14A-14C.

Having reference to FIG. 15 and for sandline system 1 operation, at block 300 the sandline PLC 122 sets the sandline motor 124 speed setpoint M at a maximum running speed. At block 301, the operator controls the sandline motor 124 through a joystick which is also set at maximum speed for running a swabbing tool 36*s* into or out of the wellbore 28 (FIG. 14B) at block 302. At block 303 as the swabbing tool 36*s* approaches a target location T (FIGS. 14A and 14C), the sandline PLC 122, at block 304, reduces the maximum sandline speed to a maximum target speed. At block 305, once the swabbing tool 36*s* leaves the target location T, the sandline PLC 122, increases the speed setpoint M once again to the maximum running speed (FIG. 14B).

The embodiments of the invention in which an exclusive property or privilege is claimed are defined as follows:

1. An electrically-powered well service rig comprising:

a mobile platform for transporting the service rig;

an engine-driven generator carried by the platform for generating AC power;

a propulsion system carried by the platform for transporting the mobile platform service rig having a collapsible mast thereon, the propulsion system having a permanent magnet propulsion motor for driving the platform, a propulsion variable frequency drive (VFD) connected between the generator and the propulsion motor and a propulsion programmable logic controller (PLC) outputting speed setpoints to the propulsion VFD;

a drawworks system carried by the platform and having blocks adapted for raising and lowering a plurality of tubulars into and out of a wellbore, the tubulars having one or more flag locations thereon, the drawworks system having at least a drawworks drum having drawworks cable wound thereon and rotatably driven by a permanent magnet drawworks motor; a drawworks VFD connected between the generator and the drawworks motor and a drawworks PLC outputting speed setpoints to the drawworks VFD;

drawworks sensors for establishing measures of the running position of the one or more flag locations and communicating said measures to the drawworks PLC; and one or more target locations representing physical positions on or off the service rig wherein the drawworks PLC reduces the maximum speed setpoint for the drawworks VFD as the flag locations of the tubing are within a window distance of the target location; and a sandline system carried by the platform and adapted for raising and lowering a sandline tool into and out of a wellborn, the sandline system having at least a sandline drum having sandline cable wound thereon and rotatably driven by a permanent magnet sandline motor; a sandline VFD connected between the generator and the sandline motor and a sandline PLC for outputting speed data points to the sandline VFD.

2. The electrically-powered well service rig of claim 1 wherein the propulsion system further comprises:

at least a semi-automatic manual transmission; and a transmission PLC for controlling the transmission, wherein the propulsion PLC receives a desired road speed signal for forwarding to the transmission PLC;

the transmission PLC communicates speed setpoints to the propulsion PLC for adjusting a motor speed of the propulsion motor to achieve the desired road speed.

3. The electrically-powered well service rig of claim 1 further comprising an electrical motor braking system for one or more of the propulsion VFD, drawworks VFD and sandline VFD.

4. The electrically-powered well service rig of claim 3 wherein the motor braking system further comprises a dynamic and a regenerative braking system.

5. The electrically-powered well service rig of claim 1 further comprising a wet multi-disc brake for one or both of the drawworks VFD and sandline VFD.

6. The electrically-powered well service rig of claim 1 wherein the one or more flag locations are tubing collars of the plurality of tubulars in a production string, and the target locations are at least a rig floor position and crown position.

7. The electrically-powered well service rig of claim 1 wherein the drawworks drum further comprises a drawworks shaft, the drawworks sensors further comprising a drawworks shaft encoder and a block load sensor.

8. The electrically-powered well service rig of claim 1 wherein, the drawworks PLC is programmed for raising and lowering plurality of tubulars having collars into and out of the wellbore wherein the target locations comprise at least a first rig floor position;

a second power tong position; and a third crown position, the drawworks PLC outputs setpoints to the drawworks VFD for reducing the maximum speed setpoint for the drawworks VFD as the position of the collars are within a window distance of the target locations.

9. The electrically-powered well service rig of claim 1 further comprising one or more calibration switches for signaling relative correspondence of a flag location and a target position.

10. The electrically-powered well service rig of claim 1 further comprising one or more electrical umbilicals for providing power from the generator for powering on-site apparatus.

11. The electrically-powered well service rig of claim 10 wherein the on-site apparatus comprises an independently transportable electrically-powered mud pump having a mud pump motor operatively connected to the mud pump.

12. The electrically-powered well service rig of claim 10 wherein the one or more electrical umbilicals provide power for hotel loads.

13. The electrically-powered well service rig of claim 1 wherein one of the one or more target locations is a rig floor position.

14. The electrically-powered well service rig of claim 1 wherein one of the one or more target locations is a crown position.

15. The electrically-powered well service rig of claim 1 wherein one of the one or more target locations is a bottom of the well.

16. An electrically-powered well service rig comprising:

a mobile platform for transporting the service rig, an engine-driven generator carried by the platform for generating AC power;

a propulsion system carried by the platform for transporting the mobile platform service rig having a collapsible mast thereon, the propulsion system having a permanent magnet propulsion motor for driving the platform, a propulsion variable frequency drive (VFD) connected between the generator and the propulsion motor and a propulsion programmable logic controller (PLC) outputting speed setpoints to the propulsion VFD;

a drawworks system carried by the platform and having blocks adapted for raising and lowering a plurality of tubulars having one or more flag locations thereon into and out of a wellbore, the drawworks system having at least a drawworks drum having drawworks cable wound thereon and rotatably driven by a permanent magnet drawworks motor; a drawworks VFD connected between the generator and the drawworks motor and a drawworks PLC outputting speed setpoints to the drawworks VFD;

a sandline system carried by the platform and adapted for raising and lowering a sandline tool into and out of a wellbore, the sandline tool having one or more flag locations thereon, the sandline system having at least a sandline drum having sandline cable wound thereon and rotatably driven by a permanent magnet sandline motor; a sandline VFD connected between the generator and the sandline motor and a sandline PLC outputting speed setpoints to the sandline VFD; and sandline sensors for establishing measures of the position of the one or more flag locations and communicating said measures to the sandline PLC; and one or more target locations wherein the sandline PLC reduces the maximum speed setpoint for the sandline VFD as the position of the one or more flag locations of the sandline tool are within a window distance of the target locations.

17. The electrically-powered well service rig of claim 16 wherein the one or more flag locations are the top and bottom of a swabbing tool, and the target locations are a rig floor position and a bottom of the well.

18. The electrically-powered well service rig of claim 16 wherein the sandline drum further comprises a sandline shaft, the sandline sensors further comprising a sandline shaft encoder.

19. The electrically-powered well service rig of claim 16 wherein, the sandline PLC is programmed for raising and lowering a sandline tool having a top end and a bottom end into and out of the wellbore wherein the target locations comprise at least a first bottom hole position;

a second wellhead [lubricator] position, and a third crown position, the sandline PLC outputting setpoints to the sandline VFD for reducing the maximum speed setpoint for the sandline VFD as the position of the sandline tool top end and bottom end are within a window distance of the target locations.

20. The electrically-powered well service rig of claim 16 further comprising one or more calibration switches for signaling relative correspondence of a flag location and a target position.

* * * * *